US005913785A

United States Patent [19]

Møller et al.

[11] Patent Number: 5,913,785

[45] Date of Patent: Jun. 22, 1999

[54] SKYLIGHT WINDOW ASSEMBLY

[75] Inventors: Brent Møller, Gentofte, Denmark; Samuel Howard Darmer, Greenwood, S.C.

[73] Assignee: Velux Industri A/S, Soborg, Denmark

[21] Appl. No.: 09/044,682

[22] Filed: Feb. 25, 1998

[51] Int. Cl.[6] ..... E04B 7/18

[52] U.S. Cl. ..... 52/200; 49/DIG. 1; 52/220.8; 52/217; 52/204.56

[58] Field of Search ..... 52/200, 220.8, 52/217, 204.56

[56] References Cited

U.S. PATENT DOCUMENTS

| | | | |
|---|---|---|---|
| 4,520,604 | 6/1985 | Halsey | 52/200 |
| 4,757,655 | 7/1988 | Jentoft et al. | 52/200 |
| 4,862,657 | 9/1989 | Jentoft et al. | 52/200 |
| 4,930,275 | 6/1990 | Verby et al. | 52/200 |
| 4,972,638 | 11/1990 | Minter | 52/200 |
| 5,544,455 | 8/1996 | DeBlock . | |
| 5,682,713 | 11/1997 | Weiss | 52/200 |

*Primary Examiner*—Christopher Kent
*Assistant Examiner*—Dennis L. Dorsey
*Attorney, Agent, or Firm*—Lane, Aitken & McCann

[57] ABSTRACT

A skylight window assembly comprises a curb frame having top edges for supporting a skylight window with glazing supported in a frame structure. Inside the curb frame an inner frame structure is arranged in floating suspension with respect to the curb frame to provide engaging means for panel members of an underlying shaft through the roof structure and at the same time to prepare for arrangement of an accessory like a screening device in connection with the window.

19 Claims, 1 Drawing Sheet

SKYLIGHT WINDOW ASSEMBLY

BACKGROUND OF THE INVENTION

In the installation of skylight windows in roof structures of the kind comprising plywood plate members secured to the rafters of the structure it is customary practice prior to the installation to cut a hole or an opening through the plate members and the external roof covering secured thereto in order to localize the rafters and avoid damaging when the greater final opening for the window is cut.

After cutting the window opening a curb frame of a form matching the opening is mounted and secured to the roof structure. The curb frame is normally of a rectangular form and composed of four wall members having top edges forming engagement surfaces for part of the window frame structure. Usually the curb is positioned on and secured to rim portions of the roof plate members surrounding the opening.

Following the mounting of the curb a flashing membrane, which is typically made of roof board or metallic flashing members is applied to the external curb surfaces to provide a watertight joint between the curb and the surrounding roof covering.

The skylight window is then arranged in sealing engagement against the top edges of the curb wall members, Typically, the window will be provided with external weather protective covering members which may form a skirt projecting somewhat downwards on the external side of the curb and the flashing membrane applied thereto to provide further protection to the curb and serve to secure the window with respect to the curb by appropriate fastening means, e.g. in the form of nails or screws forced through holes in the skirt into the curb wall members.

Subsequently the curb is usually lined on the internal side of its wall members by suitable panel members like plasterboards forming a shaft extending through the curb as well as the underlying roof structure and insulation. Frequently, this lining operation is made difficult and complicated by the fact that in case of a less accurate cutting of the roof opening parts of the roof plate members may project into the opening at the lower end of the curb, such that a cumbersome individual adaption of the lining members becomes necessary.

Moreover, the need for individual adaption of lining members will frequently reduce the space available for mounting a skylight shade in the form of a venetian blind, a roller blind or a pleated blind, so that the dimensions of standard designs of such accessories will not fit into the available space. Thereby, also accessories which are normally desired for skylight windows may have to be individually adapted, and the window installation will become more complicated and expensive.

U.S. Pat. No. 5,544,455 to DeBlock discloses a skylight frame and curb assembly of the general structure described above, in which the curb provides at least one serrated wall to receive a modular shaft extending from the curb to an opening formed in a ceiling and including a number of panels to each of which a hook with at least one serrated wall is mounted. The hooks of the shaft panels fit into the channel defined by the curb such that the serrated walls contact one another and secure the shaft to the curb by a ratcheting effect.

In this design the need to provide the shaft panel members with special hook members having a serrated wall to engage the serrated wall of the curb complicates the structure without providing any solution to the problems following from a less accurate cutting of the roof opening.

In the curb assembly disclosed in U.S. Pat. No. 5,544,455 a channel for receiving a screening device is formed by flanges projecting from the inner side of the curb frame itself, which together with the need to provide the curb with at least one serrated wall restricts the curb frame to being made from a polymeric material.

SUMMARY OF THE INVENTION

On the prior art background described above it is the object of the present invention to provide a skylight window assembly of a relatively simple design, by which the lining with panel members to form the shaft can be implemented to absorb inaccuracies resulting from the cutting of the roof opening, while at the same time the skylight window assembly with curb and shaft is prepared for subsequent installation of an accessory such as a shade in standard measurements for the actual skylight window.

A further object of the invention is to facilitate the installation of skylight windows by providing a skylight window assembly including a curb frame composed of few components which must be arranged from the external side of the roof and designing said components for easy handling at the site of installation.

According to the invention, these and other objects are achieved by provision of a skylight window assembly, comprising a substantially rectangular curb for installation in a roof structure, said curb having wall members extending in planes substantially at right angles to an external surface of said roof structure around an opening cut in therein, top edges of said wall members projecting above said external roof surface, a skylight window including a window glazing retained in a frame structure resting on said top edges and secured to said curb, an internal shaft composed of a number of panel members and forming a lining extending from the curb to an internal wall or ceiling inside the roof structure, and an inner frame structure arranged with floating suspension with respect to said curb for mounting of accessories and forming top engagement means for the panel members of said shaft.

BRIEF DESCRIPTION OF THE DRAWINGS

An illustrative embodiment of the skylight assembly according to the invention will now be explained below with reference to the schematical drawings, in which.

DETAILED DESCRIPTION OF THE INVENTION

Figure 1:
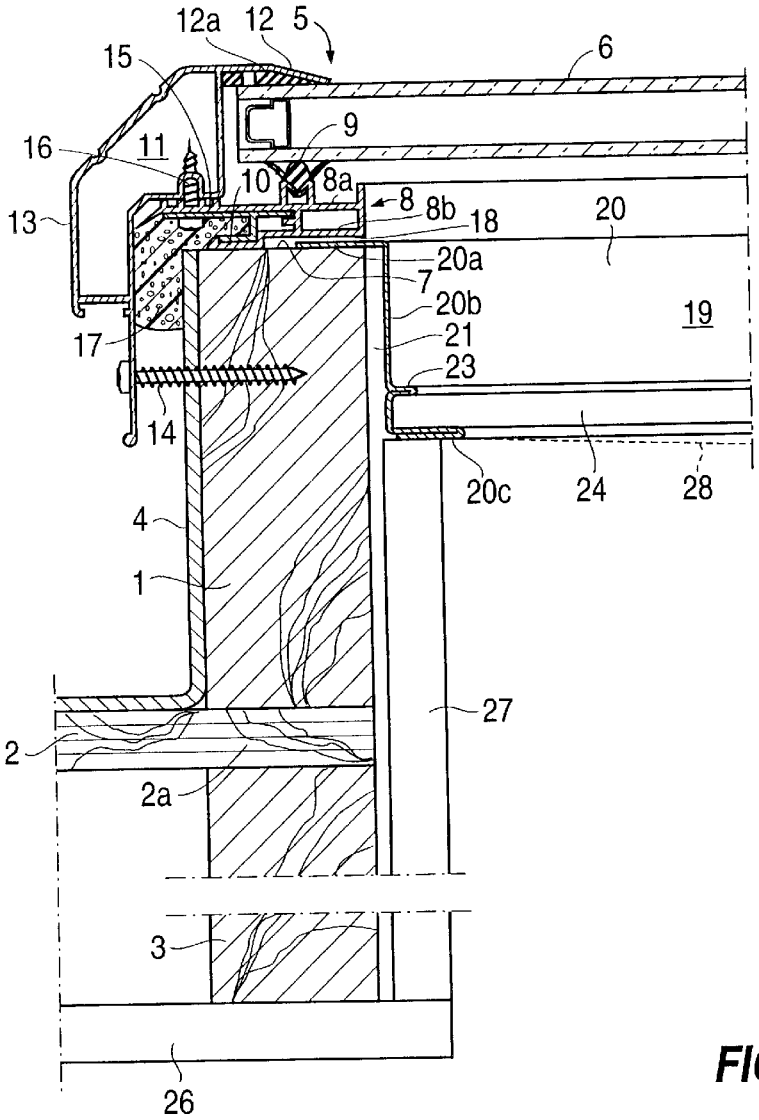
FIG. 1 is a sectional view of one side of the skylight window assembly.

FIG. 1 shows a wall member 1 constituting one side of a generally rectangular curb frame matching the size of a skylight window frame. The curb wall member 1 is positioned on and secured to a roof plate member 2 such as a plywood member along a rim part 2*a* of the roof plate 2 defining a roof opening which has been cut for the installation of the skylight window, normally in alignment with a pair of rafters 3 forming part of the roof structure underlying the roof plates 2, only one of said rafters being shown in FIG. 1.

To the external side of the curb a weather protective flashing membrane 4 is applied to form a watertight joint between the curb and the external roof covering on the roof plates 2, said flashing membrane being typically made of roof board or metallic flashing members.

A skylight window frame generally denoted 5 and carrying glazing member such as a thermopane 6 or a conventional skylight cupola is arranged to rest on a top edge surface 7 of the curb wall member 1.

The window frame 5 is composed of only two interconnected parts, i.e. an inner frame profile 8 and an external frame profile 11, preferably in the form of extruded profiles of aluminium or a plastic material.

The inner frame profile 8 is a relatively flat hollow profile, preferably made as an extruded profile of a plastic material, having a first wall 8*a* including means for retaining a sealing member 9 engaging the inner side of thermopane 6 and a second wall 8*b* formed with a projecting foot part 10 providing engaging means resting on top edge surface 7 of curb wall member 1.

An external frame profile 11 comprises an edge flange 12 forming a glazing strip engaging the outer side of thermopane 6 via a sealing strip 12*a,* e.g. of a silicone compound, and a corner profile 13 forming a skirt extending somewhat downwards on the external side of the curb wall member 1 and the flashing membrane 4 secured thereto. The corner profile 13 may partly form a hollow profile, e.g. of aluminum and serves to provide further weather protection to the curb and permit the window frame 5 to be secured to the curb by means of screws 14 screwed into the curb walls. The inner frame profile 8 is connected via a metallic reinforcement profile 15 with the external profile 11 by means of screws 16 received in screw bushings formed integrally with the part of the corner profile 13 adjacent the thermopane 6.

A sealing member 17 which may be of foam rubber is arranged at the joint between the inner frame profile 8 and the external frame profile 11 to protect the corner of wall member 1 between the top edge surface 7 and the flashing membrane 4.

The positioning of the inner frame profile 8 to rest on the top edge surface 7 of the curb wall member 1 by means of projecting foot parts 10 provides a slit-like clearance 18 between the underside of frame profile 8 and top edge surface 7 for floating suspension of an inner curb frame structure generally denoted by 19.

The inner curb frame 19, which serves the twofold purpose of mounting accessories such as shades and forming top engagement means for panel members of a shaft lining the opening through the roof structure, is generally rectangular and comprises frame members 20 of a generally Z-shaped cross sectional profile with a top flange 20*a* interposed into the slit-like clearance 18 between the inner frame profile 8 of the window frame 5 and the top edge surface 7 of curb wall member 1.

Adjoining top flange 20*a* the frame member 20 comprises a depending side wall 20*b* extending generally parallel to the curb wall member 1, but having a length less than the dimension of wall member 1 in a plane parallel to the external roof surface defined by roof plates 2, such that a clearance 21, which may range from 5 to 20 mm is provided between the inner frame side walls 20*b* and the curb wall members 1 to allow for floating suspension of the inner frame structure 19 with respect to the curb frame.

Adjoining the side wall 20*b* each frame member 20 of the inner frame structure 19 is formed with an inwardly projecting bottom flange 20*c* substantially parallel to top flange 20*a,* which provides top engagement means for panel members of an underlying shaft structure to be explained in the following and also serves to engage and retain guide means for accessories such as a shade.

In the embodiment shown the bottom flange 20*c* forms together with a folded, inwardly projecting intermediate flange member 23 projecting from side wall 20*b* a track 24 providing a snap engagement means for a shade such as a roller blind or a pleated blind.

Figure 2:
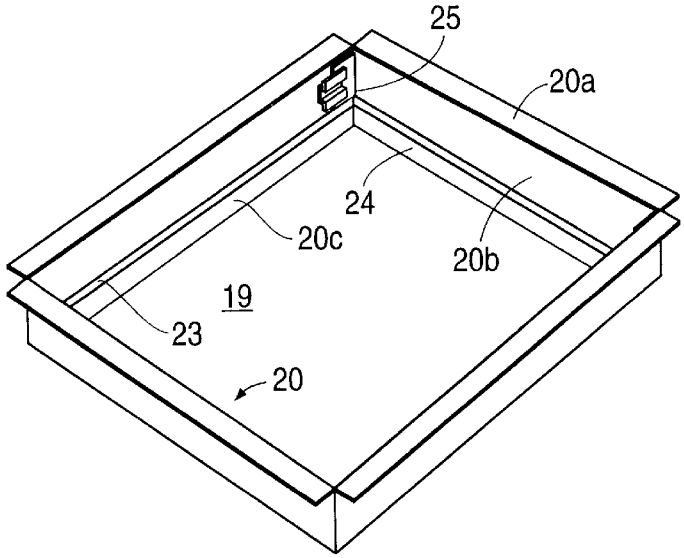
FIG. 2 is a perspective view of a floating inner frame of the assembly.

The inner frame structure 19 may as illustrated in FIG. 2 be formed as a single integral frame, e.g. by injection moulding of a plastic material or it may be made of separate frame members such as extruded aluminium profiles or roll-formed metallic profiles, which are interconnected, e.g. by welding, at the corner joints.

In either case, guide rails for a shade or other form of accessory may be arranged by snap engagement in the track 24 formed between the bottom and intermediate flanges 20*c* and 23 of two opposed inner frame members 20 at which fittings 25 adapted for connection with a support member of such a shade may be provided at the inner side of the frame 19.

The lining shaft to be arranged to extend through the lower part of the curb frame from immediately below the bottom flanges 20*c* of the frame members 20 of the floating inner frame structure 19 and further through the underlying roof structure to an inner ceiling or sloping wall 26 is composed of panel members 27 such as plasterboards, which are mounted with their top edges engaged by the bottom flanges 20*c* of the inner frame 19. Such panel members may be secured to the curb wall members 1 and the ceiling or sloping wall in a manner not illustrated.

The inner frame structure of the invention is arranged after installation of the curb frame 1 prior to positioning the window frame 5. At the subsequent installation of the shaft panel members 27 the floating inner frame 19 may due to its clearance with respect to the curb wall members 1 easily be shifted in any direction to a position in alignment with the shaft panel members.

In order to protect the skylight window with its frame members and thermopane in connection with subsequent painting of the panel members 27, the inner frame may be supplied, as shown in dashed lines, with a disposable paint shield 28, e.g. of a plastic foil material, retained by the folded bottom flanges 20*c*.

The inner frame structure of the invention can be made in dimensions matching those of any standard size of skylight windows with the described clearance to the curb frame and accessories like shades for arrangement with such windows may be supplied in standard sizes matching various standard sizes of the inner frame structure.

We claim:

1. A skylight window assembly, comprising a substantially rectangular curb for installation in a roof structure, said curb having wall members adapted to extend in planes substantially at right angles to an external surface of the roof structure around an opening cut therein, said wall members having top edges adapted to project above the external roof surface, a skylight window including a window glazing member retained in a window frame structure resting on said top edges and secured to said curb, an internal shaft composed of a number of panel members and forming a lining projecting from the curb and adapted to extend to an internal wall or ceiling inside the roof structure, and an inner frame structure arranged with floating suspension with respect to said curb for mounting of accessories and forming top engagement means for the panel members of said shaft.

2. A skylight window assembly as claimed in claim 1, wherein said skylight window is prefabricated with said glazing member comprising a thermopane secured in said window frame structure which is composed of two interconnected frame members, including an inner frame member engaging an inner side of said thermopane and having engaging means for resting on said top edges of said curb wall members and an external frame member forming a glazing strip engaging an outer side of said thermopane integrally connected with a corner profile extending on the external side of said curb wall members.

3. A skylight window assembly as claimed in claim 2, wherein the corner profile of said external frame member comprises a generally L-shaped profile member including means for receiving a first fastening member for connection of said inner frame member of said window frame structure and a second fastening member for securing said window frame structure to said curb wall members.

4. A skylight window assembly as claimed in claim 3, wherein a sealing member is interposed between said external frame member and said curb.

5. A skylight window assembly as claimed in claim 2, wherein said inner frame member of said window frame structure comprises a generally flat hollow profile member having a first wall including means for retaining a seal resting against said thermopane inner side and a second wall generally parallel to said first wall and being provided with a projecting foot part forming said engaging means while leaving a slit-like clearance between said second wall and said top edge of the curb wall member.

6. A skylight window assembly as claimed in claim 1, further comprising a shade as an accessory.

7. A skylight window assembly as claimed in claim 6, wherein said shade is a venetian blind.

8. A skylight window assembly as claimed in claim 6, wherein said shade is a roller blind.

9. A skylight window assembly as claimed in claim 6, wherein said shade is a pleated blind.

10. A skylight window assembly as claimed in claim 1, wherein said wall members of said curb have a length, and said inner frame structure comprises frame members with top flanges interposed between said top edges of the curb and at least a part of said window frame structure resting thereon, and depending side walls extending generally parallel to the wall members of the curb, said side walls having a length less than the length of said wall members to provide a clearance between said wall members and said side walls for said floating suspension of said inner frame structure with respect to said curb.

11. A skylight window assembly as claimed in claim 10, wherein the frame members of said inner frame structure are made of metal profiles bent to provide said top flanges and side walls.

12. A skylight window assembly as claimed in claim 10, wherein said inner frame structure is made as an integral rectangular frame fitting with said clearance inside said curb.

13. A skylight window assembly as claimed in claim 10, wherein said inner frame structure is made of separate frame members interconnected with each other.

14. A skylight window assembly as claimed in claim 10, wherein said inner frame structure is made of metal.

15. A skylight window assembly as claimed in claim 10, wherein said inner frame structure is made of a plastic material.

16. A skylight window assembly as claimed in claim 10, wherein mounting fittings for accessories are secured to the side walls of a pair of opposed frame members of said inner frame structure.

17. A skylight window assembly as claimed in claim 10, wherein the frame members of said inner frame structure each has a generally Z-shaped cross-sectional profile with a bottom flange extending inwardly from said side walls substantially parallel to said top flanges, said bottom flanges forming said top engagement means for said shaft panel members and forming at least at one pair of opposed frame members of the inner frame structure means for engagement of guide members for accessories.

18. A skylight window assembly as claimed in claim 17, wherein said engagement means comprises a track formed between said bottom flange and an inwardly projecting intermediate flange member.

19. A skylight window assembly as claimed in claim 17, wherein said inner frame structure is supplied with a disposable paint shield retained by said said bottom flanges to protect the skylight window when painting said panel members.

* * * * *